United States Patent [19]

Johnson

[11] 4,261,557

[45] Apr. 14, 1981

[54] FENCE HELPER

[76] Inventor: Carlton W. Johnson, R-3, Box 157-A, Crestview, Fla. 32536

[21] Appl. No.: 91,197

[22] Filed: Nov. 7, 1979

[51] Int. Cl.[3] ..... B23Q 3/00

[52] U.S. Cl. ..... 269/46; 105/150

[58] Field of Search ..... 254/83, 134.3 R, 134.3 PA; 269/46; 118/500; 105/150

[56] References Cited

U.S. PATENT DOCUMENTS

| | | | |
|---|---|---|---|
| 538,389 | 4/1895 | Schulze | 105/150 |
| 3,137,471 | 6/1969 | Derus | 105/150 |

FOREIGN PATENT DOCUMENTS

| | | | |
|---|---|---|---|
| 551780 | 3/1931 | Fed. Rep. of Germany | 105/150 |

*Primary Examiner*—Robert C. Watson

*Attorney, Agent, or Firm*—Burns, Doane, Swecker & Mathis

[57] ABSTRACT

A method and apparatus for transferring a weight of a wire fabric to a top rail of a chain link fence is disclosed. The apparatus includes a generally L-shaped or C-shaped frame made up of straight, rectangular bars. Connected to a lower end of a leg of the L-shaped or C-shaped frame is a relatively long, rectangular bar which includes at least one hook. An axle is rigidly connected to an upper portion of the L-shaped or C-shaped frame, and a guide roller is rotatably mounted on the axle.

13 Claims, 5 Drawing Figures

Fig. 1
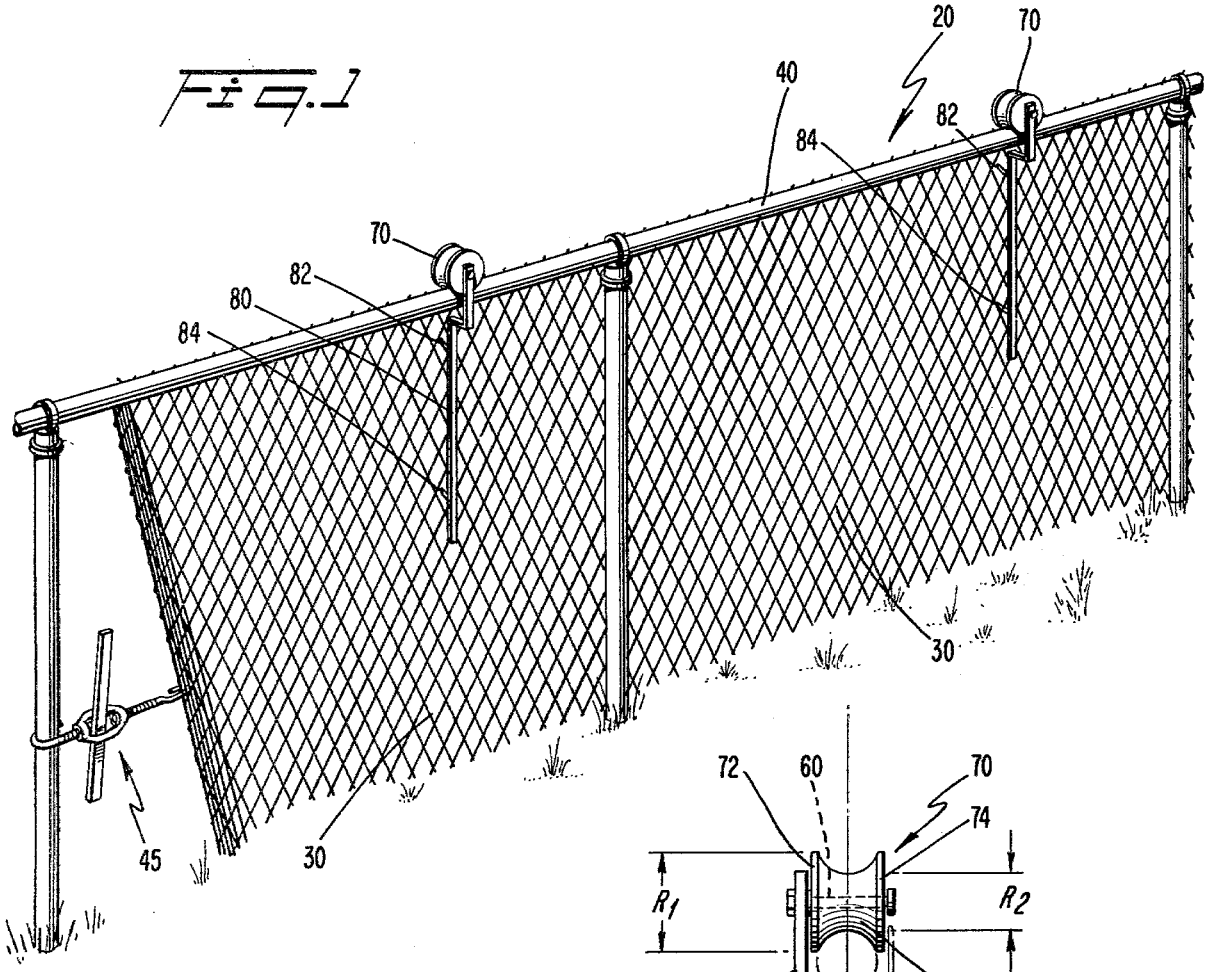
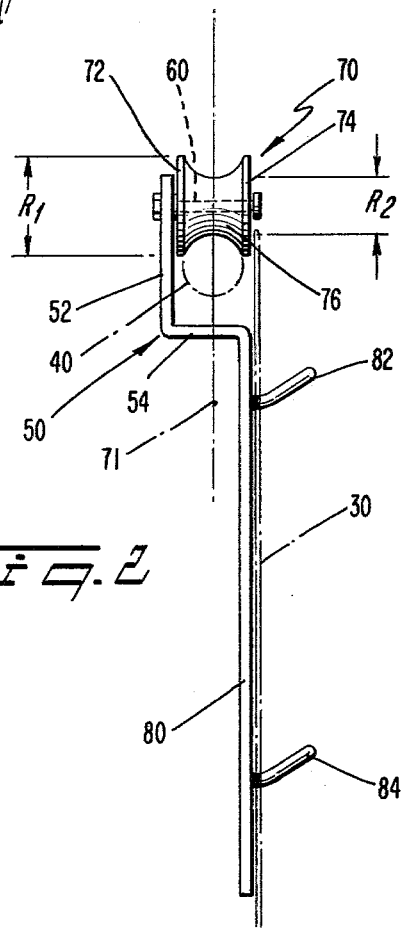
Fig. 2

FENCE HELPER

BACKGROUND AND SUMMARY OF THE PRESENT INVENTION

The invention disclosed herein pertains to an apparatus for transferring a weight of a chain link wire fabric to a top rail of a chain link fence.

A conventional method for stretching and tensioning a chain link wire fabric of a chain link fence is to have a first workman walk up and down a length of the fence and lift the wire fabric off the ground in order to free it from ground entanglements, while a second workman stretches the fabric. The work performed by the first workman, i.e., lifting the wire fabric off the ground to free the fabric from ground entanglements, is necessary if the work performed by the second workman is to result in a uniform stretching and tensioning of the wire fabric.

Various apparatus for tensioning a wire fabric of a chain link fence are known. An apparatus for tensioning a wire fabric of a chain link fence and for fastening the wire fabric to a fence or gate post, is disclosed in U.S. Pat. No. 1,738,609, issued to Pivonski et al. This apparatus includes a stretcher bar which is interlocked with a margin of the wire fabric, and a fastening and tensioning device between the stretcher bar and the fence or gate post. The fastening and tensioning device includes a shank having a hook portion in engagement with the stretcher bar, and a threaded portion which is seated in an aperture in a wall of the fence or gate post. A nut-like element, having a longitudinally divided tapering body, encircles a segment of the threaded portion of the shank, and is also seated in the aperture of the fence or gate post. A head of the nut-like element bears against an opposing outer surface of the fence or gate post.

Various apparatus for stringing power lines are known. One such apparatus for stringing power lines is disclosed in U.S. Pat. No. 3,908,962 issued to Ross. This apparatus includes first and second generally C-shaped brackets which are connected to one another, and spaced apart, by spacers. Connected to an upper portion of the C-shaped brackets is a shaft which supports a pulley, which pulley engages a messenger wire. Rotatably suspended from a post, which post connects a lower portion of the first C-shaped bracket to a lower portion of the second C-shaped bracket, is a generally diamond-shaped spacer, which spacer includes three hook-shaped recesses for receiving three wires.

Various devices for tensioning fence wires, or for stringing cables, are also disclosed in the following patents: U.S. Pat. No. 2,575,947 issued to Etnyre; U.S. Pat. No. 4,019,715 issued to Vugrek; U.S. Pat. No. 687,727 issued to Collins; and U.S. Pat. No. 3,861,650 issued to Jackson.

Considerable savings in time and money could be effected if the stretching of a chain link wire fabric of a chain link fence could be accomplished by one workman, instead of two workmen. That is, considerable savings could be effected if a lone workman could both lift the wire fabric off the ground and simultaneously tension the wire fabric.

Accordingly, a primary object of the present invention is to provide a method and apparatus for transferring a weight of a chain link wire fabric to a top rail of a chain link fence, thereby allowing a lone workman to uniformly tension the wire fabric.

Apparatus according to the present invention for transferring a weight of a chain link wire fabric to a top rail of a chain link fence includes a generally L-shaped or a generally C-shaped frame. Connected to a lower leg of the frame is a relatively straight, rectangular bar which includes at least one hook, which hook is to be inserted into the wire fabric. A shaft is rigidly connected to an upper portion of the frame, and a guide roller is rotatably mounted on the shaft. The guide roller is to be mounted on the top rail of the chain link fence.

BRIEF DESCRIPTION OF THE DRAWINGS

Preferred embodiments of the present invention are described with reference to the accompanying drawings wherein like members bear like reference numerals, and wherein:

FIG. 1 is a perspective view of a first preferred embodiment of apparatus, according to the present invention, illustrating the manner in which the invention is used to transfer a weight of a chain link wire fabric to a top rail of a chain link fence while the chain link wire fabric is tensioned;

FIG. 2 is a front view of the first preferred embodiment of apparatus, according to the present invention;

DETAILED DESCRIPTION OF THE PREFERRED EMBODIMENTS

Figure 3:
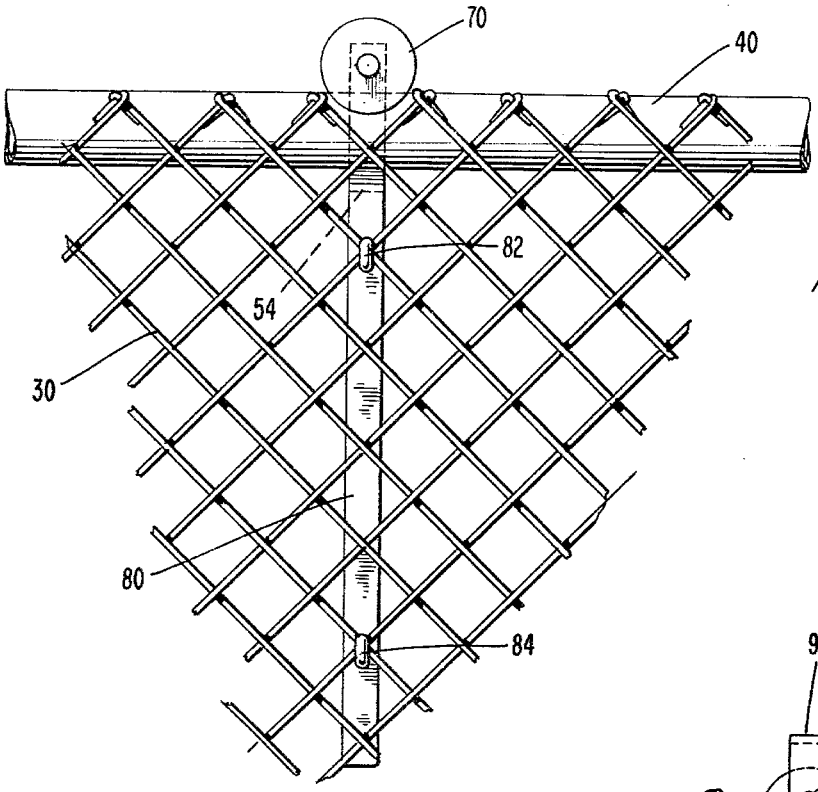
FIG. 3 is a side view of the embodiment shown in FIG. 2.

With reference to FIG. 1, a first preferred embodiment of apparatus, according to the present invention, for transferring a weight of a wire fabric 30 to a top rail 40 of a chain link fence 20, includes two hooks 82 and 84 and a guide roller 70. The hooks 82 and 84 are connected to a lower portion of the apparatus, and the guide roller 70 is connected to an upper portion of the apparatus. By inserting the hooks 82 and 84 of the apparatus into the wire fabric 30, pulling up on the apparatus and mounting the guide roller 70 on the top rail 40, the weight of the wire fabric 30 is thereby transferred to the top rail 40.

With reference to FIG. 2, the first preferred embodiment of apparatus, according to the present invention, includes a generally L-shaped frame 50. This frame 50 includes two bar-like members 52 and 54 which are connected at a substantially right angle to one another. That is, an upper end of the member 54 is connected at a substantially right angle to a lower end of the member 52. Each of the bar-like members 52 and 54 is preferably substantially straight or linear, and preferably rectangular in cross section. A length of the member 52 is preferably greater than a length of the member 54.

Rigidly connected to the L-shaped frame 50 is an axle 60. A first end of the axle 60 projects through an aperture in the bar-like member 52. An axis of the axle 60 is substantially parallel to the member 54 and substantially perpendicular to the member 52. A length of the axle 60 is approximately equal to the length of the member 54.

Rotatably mounted on the axle 60 is a guide roller 70. A longitudinal length of the guide roller 70 is approximately equal to the length of the member 54. A position of the guide roller 70, relative to the other members of the apparatus, may be defined by an imaginary plane 71 passing vertically through a central section of the guide roller 70. The guide roller 70 includes a first, cylindrical end 72 having a radius $R_1$, and a second, cylindrical end 74 which also has a radius $R_1$. Arranged between the cylindrical ends 72 and 74 is an intermediate portion 76. The imaginary plane 71 passes vertically through a central section of the intermediate portion 76. Moving from left to right a radius of an outer surface of the intermediate portion 76 first decreases smoothly from a first radius $R_1$ to a second, smaller radius $R_2$, and then smoothly increases to a radius $R_1$. When viewed in cross-section the outer surface of the intermediate portion 76 is concave in shape.

A substantially straight, bar-like member 80 is rigidly connected to a lower end of the member 54. The member 80 is substantially perpendicular to the member 54. A length of the member 80 is preferably greater than the length of the member 52.

Rigidly connected to an upper portion of the member 80 is a first hook 82, and rigidly connected to a lower portion of the member 80 is a second hook 84. Both of these hooks are generally L-shaped members which project from the member 80. The hooks 82 and 84 are substantially equal in length to one another and are both approximately equal in length to the member 54. The hooks 82 and 84 are long enough to ensure relative ease in engaging a wire fabric with these hooks.

As shown in FIG. 2, the member 80 is connected at a substantially right angle to a lower end of the member 54, which member 54 constitutes a lower leg of the L-shape frame 50. Because the axle 60 on which the guide roller 70 is mounted is substantially parallel to the member 54, and because the longitudinal length of the guide roller 70 is approximately equal to the length of the member 54, it follows that the member 80 does not lie in the imaginary plane 71 passing through the central section of the guide roller 70. Rather, the member 80 is spaced apart from, and positioned to the right of (as shown in FIG. 2), the imaginary plane 71. Having the member 80 positioned to the right of the imaginary plane 71 is a preferred feature of the first embodiment of the present invention because, in use, a wire fabric is initially placed against an outside face of the posts and top rail of a fence, and then the wire fabric is engaged by the hooks 82 and 84 projecting from the member 80 from an inside face of the posts and top rail. If the hooks 82 and 84 are to reach and engage the wire fabric positioned on the outside face of the posts and top rail from the inside face, and if the guide roller 70 is to be mounted on the top rail, it is preferable for the member 80 to be positioned to the right of the imaginary plane 71. This feature is also useful in preventing the hooks 82 and 84 from pulling the wire fabric toward the inside face of the posts and top rail after the guide roller 70 is mounted on the top rail.

Having the member 80 positioned to the right of the imaginary plane 71 results in the present invention being inherently stable in use. That is, after the hooks 82 and 84 have been used to engage a wire fabric, and after the guide roller 70 has been mounted on a top rail of a fence, a weight of the wire fabric will be suspended from the hooks 82 and 84 while a reaction force from the top rail equalizing the weight of the wire fabric will lie substantially in the imaginary plane 71. Because the weight of the wire fabric is aligned to the right of the reaction force emanating from the top rail it follows that a force couple, i.e., a moment, is created which tends to rotate the first embodiment of the present invention in a clockwise direction (as viewed in FIG. 2). This tendency to rotate in the clockwise direction implies that the guide roller 70 will tend to rotate about the top rail in the clockwise direction, resulting in the present invention becoming more stably positioned on the top rail. If the first embodiment of the present invention tended to rotate in the counterclockwise direction, then the first embodiment would tend to rotate off the top rail.

With reference to FIG. 3, which is a side view of the apparatus shown in FIG. 2 in use, a weight of a wire fabric 30 is suspended from the hooks 82 and 84, while the weight is supported by a top rail 40 on which the guide roller 70 is mounted. During a stretching of the wire fabric 30 the stretching force applied to the wire fabric will induce the guide roller 70 to roll over the top rail 40 until the stretching is completed. Even as the stretching proceeds and the guide roller 70 rolls along the top rail 40, the weight of the wire fabric will be continuously borne by the top rail 40. Thus the likelihood that the wire fabric 30 will become entangled with the ground during a stretching of the wire fabric is reduced. In addition, because the weight of the wire fabric 30 is borne by the top rail 40, thereby avoiding entangling the wire fabric 30 with the ground, the entire length of the wire fabric 30 may be substantially uniformly tensioned during a stretching operation.

Each of the rectangular, bar-like members 52, 54, and 80 may, for example, be made from conventional rectangular stock material which is 1 inch wide and $\frac{1}{4}$ inch thick.

For a chain link fence of conventional size having a top rail with an outside diameter of $1\frac{3}{8}$ inch or $1\frac{5}{8}$ inch the length of the member 52 may, for example, be $3\frac{1}{2}$ inches, while the length of the member 54 may, for example, be 2 inches. The 2 inch length of the member 54 makes it possible for a wire fabric placed against an outside face of a top rail with an outside diameter of $1\frac{3}{8}$ or $1\frac{5}{8}$ inches to be engaged by the hooks 82 and 84 from an inside face of the top rail. The length of the member 80 may, for example, be 15 inches. The length of each of the hooks 82 and 84, which length is approximately equal to that of the member 54 to insure relative ease in engaging a wire fabric positioned on the outside face of a fence from an inside face may, for example, be 2 inches. The hook 82 may, for example, be connected to the member 80 at a point 2 inches below a top end of the member 80, while the hook 84 may, for example, be connected to the member 80 at a point 3 inches above a lower end of the member 80.

The axle 60 may be made from conventional round stock material and may have a diameter, for example, of $\frac{3}{8}$ inch. A length of the axle 60, which length should be comparable to the length of the member 54 may, for example, be 2 inches.

In order to fit onto a top rail having an outside diameter of $1\frac{3}{8}$ or $1\frac{5}{8}$ inch, and to be consistent with the lengths defined above, the longitudinal length of the guide roller 70 may, for example, be two inches while a length of the intermediate portion 76 of the guide roller 70 may, for example, be $1\frac{3}{4}$ inches. Thus a length of each of the cylindrical portions 72 and 74 of the guide roller 70 may, for example, be $\frac{1}{8}$ inch. A diameter of a bore in the guide roller 70 through which the axle 60 passes should, for example, be at least $\frac{3}{8}$ inch if the axle 60 has a $\frac{3}{8}$ inch diameter. The radius $R_1$ and the radius $R_2$ may, for example, be $2\frac{1}{2}$ inches and 2 inches, respectively.

Figure 4:
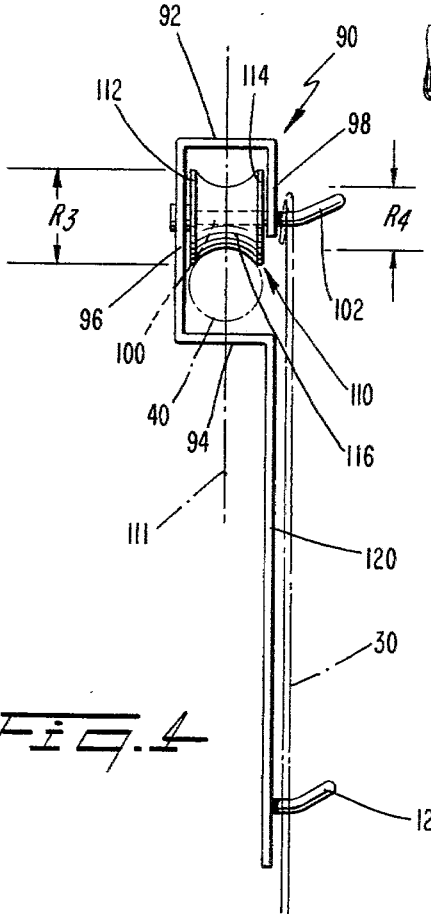
FIG. 4 is a front view of a second embodiment of apparatus, according to the present invention.

With reference to FIG. 4, a second embodiment of apparatus, according to the present invention, includes a generally C-shaped frame 90. This frame 90 includes four bar-like members 92, 94, 96, and 98 which are connected at substantially right angles to one another. That is, an upper end of the member 98 is connected at substantially a right angle to a lower end of the member 92, while an upper end of the member 92 is connected at substantially a right angle to an upper end of the member 96. Furthermore, an upper end of the member 94 is connected at substantially a right angle to a lower end of the member 96. Each of the bar-like members 92, 94, 96, and 98 is preferably substantially straight or linear, and preferably rectangular in cross section. While a length of the member 92 is preferably substantially equal to a length of the member 94 a length of the member 96 is preferably greater than a length of the member 98.

An axle 100 is rigidly connected to the frame 90. A first end of the axle 100 projects through an aperture in the bar-like member 96, while a second end of the axle 60 projects through an aperture in the bar-like member 98. The second end of the axle 100, projecting from the opening in the member 98, includes a substantially L-shaped hook 102. An axis of the axle 100 is aligned substantially parallel to the bar-like members 92 and 94.

Rotatably mounted on the axle 100 is a guide roller 110. The guide roller 110 is arranged on the axle 100 between the bar-like members 96 and 98. A position of the guide roller 110, relative to the other members of the apparatus, may be defined by an imaginary plane, 111, which passes vertically through a central section of the guide roller. The guide roller 110 has a length which is less than a length of the member 92 and less than a length of the member 94. The guide roller 110 includes a first, cylindrical end 112 having a radius $R_3$, and a second, cylindrical end 114 which also has a radius $R_3$. Arranged between the cylindrical ends 112 and 114 is an intermediate portion 116. The imaginary plane 111 passes vertically through a central section of this intermediate portion 116. Moving from left to right a radius of an outer surface of the intermediate portion 116 first decreases smoothly from a first radius $R_3$ to a second, smaller radius $R_4$ and then smoothly increases to a radius $R_3$. When viewed in cross-section, the outer surface of the intermediate portion is concave in shape.

A substantially straight, bar-like member 120 is rigidly connected to a lower end of the member 94. The member 120 is substantially perpendicular to the member 94. A length of the member 120 is preferably greater than the length of the member 96.

Rigidly connected to a lower end of the member 120 is a hook 122. The hook 122 is a substantially L-shaped member which projects from the bar-like member 120. A length of the hook 122 is approximately equal to a length of the member 94.

As with the first embodiment, the member 120 of the second embodiment is arranged to the right of the imaginary plane 111. The hook 102 projecting from the axle 110 is also arranged to the right of the plane 111. These are preferred features of the second embodiment because, in use, a wire fabric is initially placed against an outside face of the posts and top rail of a fence, and then the wire fabric is engaged by the hooks 122 and 102 from an inside face of the posts and top rail. In order that the hook 122 reach and engage the wire fabric positioned on the outside face of the posts and top rail, it is preferable for the member 120 to be positioned to the right of the imaginary plane 111. Similarly, if the hook 102 is to engage the wire fabric the hook 102 should preferably extend from the axle 110 from a point to the right of the imaginary plane 111. These features are also useful in preventing the hooks 102 and 122 from pulling the wire fabric toward the inside face of the posts and top rail after the guide roller 110 is mounted on the top rail.

The second embodiment of the present invention, like the first embodiment, is also inherently stable in use. That is, after the hooks 102 and 122 have been used to engage a wire fabric, and after the guide roller 110 has been mounted on a top rail of a fence, a weight of the wire fabric will be suspended from the hooks 102 and 122 while a reaction force from the top rail equalizing the weight of the wire fabric will lie substantially in the imaginary plane 111. Because the weight of the wire fabric is aligned to the right of the reaction force emanating from the top rail it follows that a force couple, i.e. a moment, is created which tends to rotate the second embodiment in a clockwise direction (as viewed in FIG. 4). This tendency to rotate in the clockwise direction implies that the guide roller 110 will tend to rotate in the clockwise direction about the top rail, resulting in the second embodiment becoming more stably positioned on the top rail. If the second embodiment tended to rotate in the counterclockwise direction, then the second embodiment would tend to rotate off the top rail.

Figure 5:
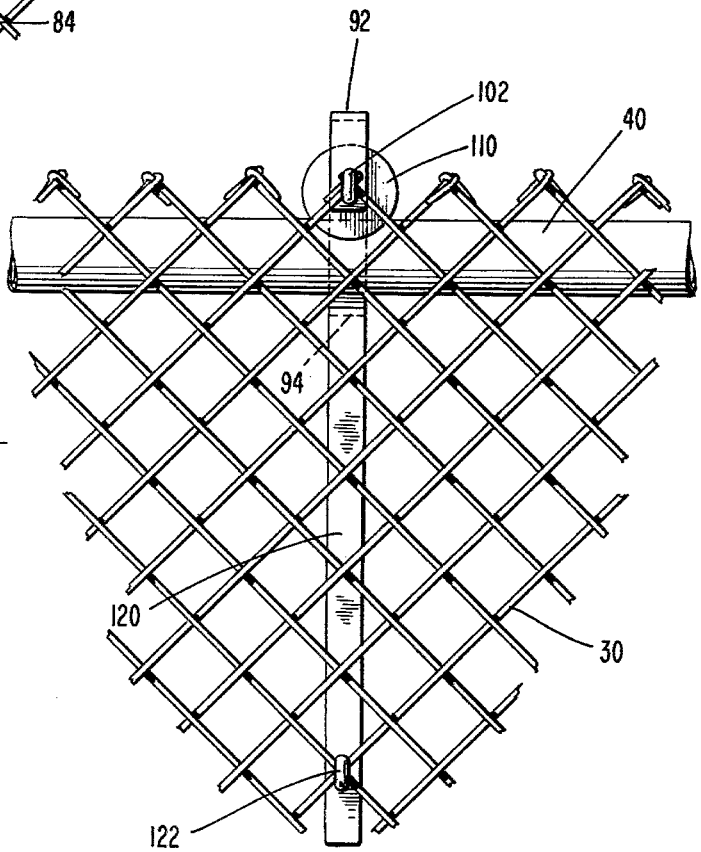
FIG. 5 is a side view of the embodiment shown in FIG. 4.

With reference to FIG. 5, which is a side view of the apparatus shown in FIG. 4 in use, a weight of a wire fabric 30 is suspended from the hooks 102 and 122, while the weight is supported by a top rail 40 on which the guide roller 110 is mounted. During a stretching of the wire fabric 30 the stretching force applied to the wire fabric will induce the guide roller 110 to roll over the top rail 40 until the stretching is completed. Even as the stretching proceeds and the guide roller 110 rolls along the top rail 40, the weight of the wire fabric will be continuously borne by the top rail 40. Thus the likelihood that the wire fabric 30 will become entangled with the ground during a stretching of the wire fabric is reduced. In addition, because the weight of the wire fabric 30 is borne by the top rail 40, thereby avoiding entangling the wire fabric 30 with the ground, the entire length of the wire fabric 30 may be substantially uniformly tensioned during a stretching operation.

The invention described above is used as follows. With reference to FIG. 1 and the first preferred embodiment of apparatus according to the present invention, a user first places an unstretched wire fabric 30 against an outside face of the posts and top rail of a fence 20. After connecting one end of the fabric to the fence, the user tensions the wire fabric slightly and then inserts the hooks 82 and 84 of the present invention into the wire fabric 30 from an inside face of the posts and top rail. The user then lifts the wire fabric 30 about 4 inches off the ground by pulling up on the apparatus, and then mounts the guide roller 70 on the top rail 40. During the subsequent stretching and tensioning of the wire fabric 30 by a conventional stretching and tensioning apparatus 45, the guide roller 70 will roll along the top rail 40 toward the stretching apparatus 45. The entire length of the wire fabric 30 stretched in this fashion will be substantially uniformly tensioned.

The manner in which one uses the second embodiment of apparatus, according to the present invention, is similar to the manner in which one uses the first embodiment.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. Apparatus for transferring a weight of a chain link wire fabric to a top rail of a chain link fence, comprising:

hook means for engaging the chain link wire fabric; and weight transfer means for stably transferring the weight of the chain link wire fabric engaged by said hook means to the top rail of the chain link fence, said weight transfer means including a rigid connection to said hook means and a roller member which may roll along said top rail of the chain link fence;

said hook means including at least one hook member provided on the same side of said rigid connection as said roller member.

2. Apparatus in accordance with claim 1 wherein said weight transfer means further includes:

an axle which is rigidly connected to said L-shaped frame;

said roller member including a guide roller, rotatably mounted on said axle, which guide roller may be mounted on the top rail of the chain link fence.

3. Apparatus in accordance with claim 1 wherein said weight transfer means further includes:

an axle which is rigidly connected to said C-shaped frame;

said roller member including a guide roller, rotatably mounted on said axle, which guide roller may be mounted on the top rail of the chain link fence.

4. Apparatus in accordance with claim 2 or claim 3 wherein said hook means is spaced apart from a plane passing through a central section of said guide roller.

5. Apparatus in accordance with claim 1 wherein said at least one hook member includes a substantially L-shaped member rigidly connected to, and projecting from, said bar, which L-shaped member may be inserted into the chain link wire fabric to engage the wire fabric.

6. Apparatus for transferring a weight of a chain link wire fabric to a top rail of a chain link fence, comprising:

hook means for engaging the chain link wire fabric; and weight transfer means, rigidly connected to said hook means, for stably transferring the weight of the chain link wire fabric engaged by said hook means to the top rail of the chain link fence, said weight transfer means including a roller member which may roll along said top rail of the chain link fence;

said weight transfer means further including a substantially C-shaped frame, an axle which is rigidly connected to said C-shaped frame, and a substantially straight bar rigidly connected to, and extending from, a leg of said C-shaped frame;

said roller member including a guide roller, rotatably mounted on said axle, which guide roller may be mounted on the top rail of the chain link fence; and said hook means including at least one substantially L-shaped member rigidly connected to, and projecting from, said bar, which L-shaped member may be inserted into the chain link wire fabric to engage the wire fabric, and at least one substantially L-shaped member rigidly connected to, and projecting from, said C-shaped frame, which L-shaped member may be inserted into the chain link wire fabric to engage the wire fabric.

7. Apparatus for transferring a weight of a chain link wire fabric to a top rail of a chain link fence, comprising:

a substantially L-shaped frame which includes a first leg and a second leg connected to said first leg at a first end of said second leg;

an axle which is rigidly connected to said first leg and substantially aligned with said second leg;

a guide roller, rotatably mounted on said axle, which guide roller may be mounted on the top rail of the chain link fence;

a substantially straight bar rigidly connected to, and extending from, a second end of the second leg of said L-shaped frame, which straight bar includes first and second opposed sides, and which straight bar is spaced apart from a plane passing through a central section of said guide roller; and hook means, connected to, and extending from, said first side of said bar, for selectively engaging the chain link wire fabric, which first side is more distant from said plane than said second side.

8. Apparatus for transferring a weight of a chain link wire fabric to a top rail of a chain link fence, comprising:

a substantially C-shaped frame which includes at least a first leg and a second leg connected to said first leg at a first end of said second leg;

an axle which is rigidly connected to said first leg and substantially aligned with said second leg;

a guide roller, rotatably mounted on said axle, which guide roller may be mounted on the top rail of the chain link fence;

a substantially straight bar rigidly connected to, and extending from, a second end of the second leg of said C-shaped frame, which straight bar includes first and second opposed sides, and which straight bar is spaced apart from a plane passing through a central section of said guide roller;

first hook means, connected to, and extending from, said first side of said straight bar, for selectively engaging the chain link wire fabric, which first side is more distant from said plane than said second side; and second hook means, connected to said C-shaped frame, for selectively engaging the chain link wire fabric.

9. A method for transferring a weight of a chain link wire fabric to a top rail of a chain link fence, comprising the steps of:

engaging a chain link wire fabric with at least one hook, which hook is rigidly connected to an apparatus which includes a guide roller rotatably connected to a substantially L-shaped frame;

lifting the chain link wire fabric off the ground by pulling up on the apparatus to which the at least one hook is connected;

mounting the guide roller on the top rail of the chain link fence; and rolling the guide roller along the top rail of the chain link fence.

10. A method for transferring a weight of a chain link wire fabric to a top rail of a chain link fence, comprising the steps of:

engaging a chain link wire fabric with at least one hook, which hook is rigidly connected to an apparatus which includes a guide roller rotatably connected to a substantially C-shaped frame;

lifting the chain link wire fabric off the ground by pulling up on the apparatus to which the at least one hook is connected;

mounting the guide roller on the top rail of the chain link fence; and rolling the guide roller along the top rail of the chain link fence.

11. Apparatus in accordance with claim 1 wherein said rigid connection includes a substantially L-shaped frame.

12. Apparatus in accordance with claim 1 wherein said rigid connection includes a substantially C-shaped frame.

13. Apparatus in accordance with claim 2 wherein said rigid connection further includes a substantially straight bar rigidly connected to, and extending from, a leg of said L-shaped frame.

* * * * *